US007217338B2

(12) United States Patent
Gustavsson et al.

(10) Patent No.: US 7,217,338 B2
(45) Date of Patent: May 15, 2007

(54) PROCESS FOR CONTINUOUSLY COOKING CHEMICAL CELLULOSE PULP

(75) Inventors: Catrin Gustavsson, Karlstad (SE); Mikael Lindstrom, Stockholm (SE); Krister Olsson, Karlstad (SE); Vidar Snekkenes, Karlstad (SE)

(73) Assignee: Kvaerner Pulping AB, Karlstad (SE)

( * ) Notice: Subject to any disclaimer, the term of this patent is extended or adjusted under 35 U.S.C. 154(b) by 239 days.

(21) Appl. No.: 10/494,397

(22) PCT Filed: Dec. 4, 2002

(86) PCT No.: PCT/SE02/02225

§ 371 (c)(1),
(2), (4) Date: May 3, 2004

(87) PCT Pub. No.: WO03/060229

PCT Pub. Date: Jul. 24, 2003

(65) Prior Publication Data

US 2004/0261960 A1 Dec. 30, 2004

(30) Foreign Application Priority Data

Dec. 5, 2001 (SE) ..... 0104063

(51) Int. Cl.
*D21C 7/14* (2006.01)
*D21C 3/24* (2006.01)
*D21C 3/26* (2006.01)

(52) U.S. Cl. ..... 162/44; 162/19; 162/41; 162/42; 162/43; 162/17

(58) Field of Classification Search ..... 162/19, 162/37, 39, 72, 17, 42–45
See application file for complete search history.

(56) References Cited

U.S. PATENT DOCUMENTS 3,383,277 A * 5/1968 Gordon et al. ..... 162/19
3,617,431 A * 11/1971 Croon et al. ..... 162/17
4,561,936 A * 12/1985 Samuelson ..... 162/45
4,670,098 A * 6/1987 Thorsell et al. ..... 162/29
4,681,935 A * 7/1987 Forss et al. ..... 536/56
4,929,307 A * 5/1990 Kiiskila et al. ..... 159/47.3

(Continued)

FOREIGN PATENT DOCUMENTS

EP 313730 A1 * 5/1989

*Primary Examiner*—Eric Hug
(74) *Attorney, Agent, or Firm*—Rolf Fasth; Fasth Law Offices

(57) ABSTRACT

The process is for continuously cooking chemical pulp in a digester system consisting of at least one vessel for impregnating and cooking comprising an inlet into which a mixture of chips and process liquid is fed. The chips are impregnated at a predetermined impregnation temperature, $T_{imp}$, and cooked at a predetermined cooking temperature, $T_{cook}$, after which dissolved pulp is fed out at the outlet of the digester system. The process liquid which is continually extracted is retained outside the digester system during a dwell time, t, of at least 30 min, without any heating above 140°, and thereafter returned to the digester system to a position which is substantially at the same level as the extraction, or downstream thereof, and thereby constitute part of the process liquid in the subsequent treatment zone. The process results in improved tear strength, beatability, bleachability and reduced color reversion, and increased yield across the digester.

7 Claims, 4 Drawing Sheets

U.S. PATENT DOCUMENTS

| | | | | |
|---|---|---|---|---|
| 5,547,012 | A * | 8/1996 | Marcoccia et al. | 162/42 |
| 5,882,477 | A * | 3/1999 | Laakso et al. | 162/63 |
| 5,885,414 | A * | 3/1999 | Lindstrom et al. | 162/19 |
| 6,261,413 | B1 * | 7/2001 | Hepp | 162/19 |
| 6,464,827 | B1 * | 10/2002 | Colodette | 162/63 |
| 6,468,390 | B1 * | 10/2002 | Snekkenes et al. | 162/19 |
| 6,475,338 | B1 * | 11/2002 | Jiang et al. | 162/19 |
| 6,776,876 | B1 * | 8/2004 | Vuorinen et al. | 162/65 |
| 6,830,655 | B2 * | 12/2004 | Siika-Aho et al. | 162/72 |
| 2002/0139497 | A1 * | 10/2002 | Jiang et al. | 162/76 |
| 2004/0112554 | A1 * | 6/2004 | Snekkenes et al. | 162/19 |

* cited by examiner

PROCESS FOR CONTINUOUSLY COOKING CHEMICAL CELLULOSE PULP

PRIOR APPLICATION

This application is a U.S. national phase application based on International Application No. PCT/SE02/02225, filed 4 Dec. 2002, claiming priority from Swedish Patent Application No. 0104063-3 filed 5 Dec. 2001.

TECHNICAL FIELD

The present invention relates to a process for continuously cooking chemical cellulose pulp.

STATE OF THE ART

In connection with the continuous cooking of cellulose pulp, several methods have been developed for, in different ways, obtaining an increased yield and improving the quality of the pulp. Many of these methods have focused on different ways of controlling the concentration of alkali in the digester in order to thereby exert an influence on the delignification process. It has also been established that, in order to achieve a uniform quality, it is of great importance for the alkali profile over the cross section of the digester to be kept as uniform as possible.

Various proposals for adjusting the alkali during the cooking in the digester have been used with a view to evening out the alkali profile during the cooking. For example, it is possible to employ adjustment circulations, in which a quantity of cooking liquid is extracted from the digester and returned to the digester after the alkali has been adjusted or in which cooking liquid which has been drawn off and which is returned to the digester is wholly or partially replaced with dilution liquid, something which first and foremost results in a reduction in dissolved organic material, i.e. what is termed DOM, with the DOM principally consisting of hemicellulose and lignin but also containing cellulose and other extractive substances from the wood chips. However, extracting cooking liquid at several positions and then replacing the extracted cooking liquid with another liquid results in a decrease in yield since fibre residues and hemicellulose are lost together with the extracted cooking liquid.

The MCC technique, i.e. Modified Continuous Cooking, which involved the alkali being divided up into several separate additions, was developed during the 1980s. This technique made it possible to even out the alkali profile in the cooking to a certain degree.

Another method of improving the quality of the pulp was developed in the form of the ITC, i.e. Iso Thermal Cooking, technique, in which the cooking temperature and the alkali level were reduced relative to the prior art and kept at a constant level-during the whole of the cooking.

With a view to evening out the alkali profile during the cooking still further, a new initiative is now to employ very high liquid/wood ratios in preimpregnation vessels and the cooking zones of the digester. This technique constitutes one of the principles in the COMPACT COOKING™ concept developed by Kvaerner Pulping. This makes it possible to reduce the alkali concentration in the cooking liquid at the same time as the quantity of alkali which is required for an efficient neutralization process is nevertheless present in the cooking liquid.

One method of increasing the yield has been to add polysulphide during the cooking; however, a characteristic of the polysulphide is that it is to some degree broken down thermally by the high cooking temperature before there is any yield-increasing effect on the pulp.

SE0100982-8 discloses a system in which the aim is to increase the yield over the course of the cooking. By means of a system in which cooking liquid is returned from underlying cooking zones to the first cooking zone, such that a high liquid/wood ratio is established at the beginning of the cooking, with this ratio then gradually decreasing during the cooking process, the System according to the invention also results in it being possible to ensure that the alkali concentration, which, in a typical example, varies from 24 g/l to 6 g/l, in the cooking liquid varies to a lesser degree during the cooking; the main point is, however, that it is possible to dispense with high concentrations of alkali at the beginning of the cooking. This is achieved without it being necessary to add large quantities of white liquor/alkali in the intermediate phase of the cooking and, in connection with this, introduce powerful circulations which establish a uniform loading of white liquor over the whole of the pulp column.

U.S. Pat. No. 5,547,012 (CIP of U.S. Pat. No. 5,489,363) specifies a method for improving the quality of the pulp with regard to strength properties and bleachability and attaining a decrease in the consumption of effective alkali (EA) and a decrease in the H factor during the cooking. This is achieved by reducing the content of dissolved organic substance, what is termed DOM, in the cooking liquid, with the DOM principally consisting of hemicellulose and lignin but also containing cellulose and other extractive substances from the wood chips. According to the patent, the content should be regulated, such that it does not exceed 100 g/l (preferably less than 50 g/l) throughout the whole of the cooking, by means of replacing DOM-rich cooking liquid from the digester's extraction circulations with cooking liquid which does not contain any DOM or only has a low content of DOM. At the same time, the patent specifies that it is especially desirable for the content of lignin to be less than 50 g/l (preferably about 25 g/l) and for the content of hemicellulose to be less than 15 g/l (preferably about 10 g/l). The DOM-free or DOM-poor cooking liquid can consist of water, white liquor which is in the main DOM-free, washing filtrate, filtrate from the digester's washing zone, i.e. what is termed cold-blow filtrate, or combinations of these. The patent also specifies that the DOM-poor liquid can consist of pressure/heat-treated black liquor. The treatment, which consists in maintaining the black liquor under pressure at a temperature of 170–350° C., preferably about 240° C., but at least 20° C. above cooking temperature, for 5–90 minutes, preferably 30–60 minutes, results in the DOM in the black liquor being passivated and forming what is termed low-active DOM, something which is said to yield a pulp of improved quality (apart from increased bleachability).

A disadvantage of the above method is that it undoubtedly generates a loss of yield since the DOM which is removed or passivated contains both dissolved hemicellulose and cellulose. In the invention, it is stated that the dissolved hemicellulose is assumed to have a large negative effect on the strength properties of the pulp and that a result of DOM being removed or passivated is that the strength properties are appreciably improved.

EP;A;313730 discloses another external treatment of the cooking liquid with a view to reducing the problems of calcium precipitates. This method requires the cooking liquid to be heated outside the digester, with the heating initiating a precipitation process which is rapidly finished. The heating has to be at least to a temperature of 300° F. (approx. 148° C.), even if heating to 314–320° F. (approx.

156–160° C.) is recommended. Heating to 314–320° F. reduces the precipitation problems by approximately 75%.

WO 001261 presents a method for increasing the yield in continuous cooking at the same time as the beatability of the pulp is improved. The aim of the method is to return xylan, which is the principal hemicellulose in hardwood and also represents a substantial proportion of the hemicellulose in softwood. The method is characterized in that extracted hemicellulose-rich liquor from the impregnation is returned to a last cooking zone in the digester in order, in this way, to enable xylan to be precipitated on the fibres during this concluding cooking stage. This return takes place directly, i.e. without the liquor undergoing any form of treatment involving a substantial dwell time. It is very important for this process that the dwell time for the xylan-rich liquor in the concluding cooking stage is kept long, typically about 60 minutes, so as to ensure that the relatively slow precipitation process has time to get underway and provide the intended increase in yield. The time is in this case a very important parameter since the precipitation initially takes place at a very low rate but subsequently increases in speed. This type of xylan precipitation can be used to increase the yield by 2–5%.

The above solution has been found to suffer from the disadvantage that it can increase the content of shives in the pulp. This problem arises if chips should happen to accompany the hemicellulose-rich liquor from the impregnation. As a result, the dwell time for these chips under cooking conditions is too short for them to have time to be sufficiently delignified.

SE 225 253 (Venemark, 1968) showed that the colour reversion of bleached pulp is successfully counteracted by treating kraft pulp either with an alkaline (pH 11.5) or acidic (pH 2.25) aqueous solution at high temperature, i.e. approximately 100° C., and for a long time, i.e. approximately 2 hours. The pulp is treated at a suitable position in the bleaching sequence. Venemark mentions several causes of colour reversion, including the content of residual lignin and carboxyl in the pulp. However, the problem still remains after careful bleaching to eliminate these substances. This is the reason for Venemark's assumption that the colour reversion is also caused by small quantities of other substances of unknown nature which are only very slowly attacked under bleaching conditions which are normally employed and using customary bleaching agents.

More recently, theories have been propounded to the effect that the colour reversion is caused by hexeneuronic acid, i.e. hex-A, in the pulp. During the cooking process, hexeneuronic acid is formed by some of the 4-O-methylglucuronic acid groups in the xylan being converted into 4-deoxy-4-hexeneuronic acid groups.

In his report "The alkaline degradation of some hardwood 4-O-methyl-D-glucuronoxylans", which was presented at the Symposium on Wood Chemistry in Washington D.C. in 1962, D. W. Clayton gave an account of his attempts to remove glucuranosyl groups from xylan with a view to producing rectilinear xylans which were free from substituent groups. By treating three representative 4-O-methyl-D-glucuranoxylans with water-containing alkali at 170° C., it was possible to demonstrate that glucuranosyl groups were being removed from the xylan. While it was possible to demonstrate traces of glucuranosyl groups after 60 minutes of treatment, these groups had been completely removed after 90 minutes. In the report, Clayton refers to previous research which established that the temperature has a major influence on the speed with which this process takes place and that the process is rapid at 170° C. However, by means of his experiments, Clayton was able to show that the glucuranosyl groups were removed much more slowly than had previously been stated.

OBJECT AND PURPOSE OF THE INVENTION

The main object of the invention is to offer a process for continuously cooking cellulose pulp which provides a pulp whose quality is improved with regard to tear strength, beatability, bleachability and reduced colour reversion at the same time as the yield across the digester increases.

Another object of the process is to decrease the consumption of cooking chemicals such as NaOH, but also polysulphide, and to decrease the H factor during the cooking process.

BRIEF DESCRIPTION OF THE INVENTION

The process according to the invention can be employed both in single-vessel digester systems and two-vessel digester systems, on digesters of both the steam-phase type and hydraulic type and on both impregnation liquor and cooking liquor. In a preferred embodiment, the process is employed such that all the extraction liquids and, in particular, the hemicellulose-rich impregnation liquid, are allowed a dwell time outside the digester before it is returned to the subsequent cooking zone. All the screen sections in the digester system can constitute extraction positions for these liquids, such that screens in the impregnation vessel and the top separator, and screens in a washing apparatus downstream of the digester, are also included.

When being applied to the impregnation liquor, the process differs in relation to an application to the cooking liquid in the respect that the impregnation liquor can be heated to the same temperature as in a subsequent cooking zone. The impregnation liquid is preferably heated to the cooking temperature before it goes to the buffer tank.

Other features and aspects, and advantages, of the invention are evident from the subsequent patent claims and from the following detailed description of some embodiments.

DETAILED DESCRIPTION

Figure 1A:
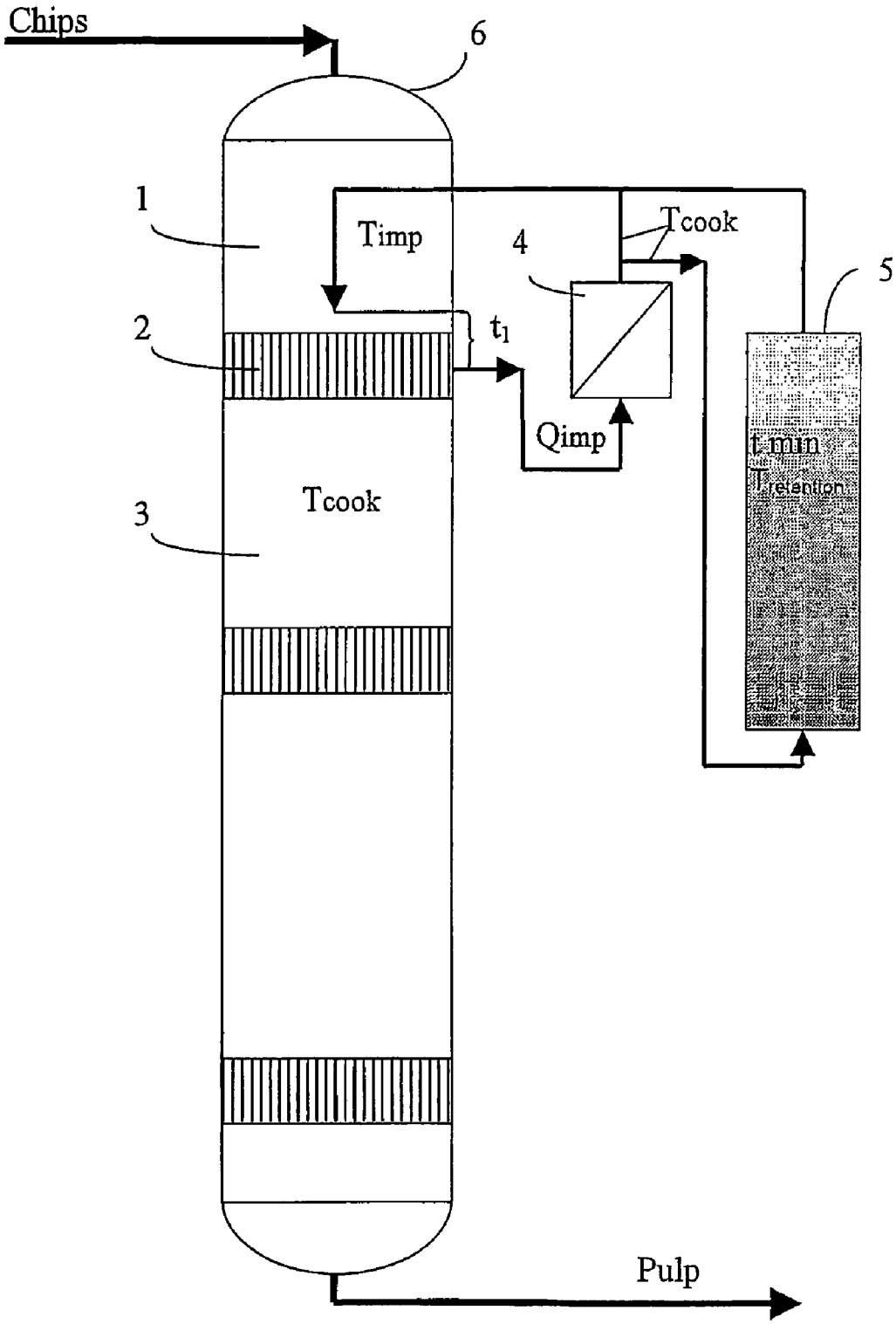
FIG. 1*a* shows an application to the impregnation liquor in a single-vessel cooking system.
Figure 1B:
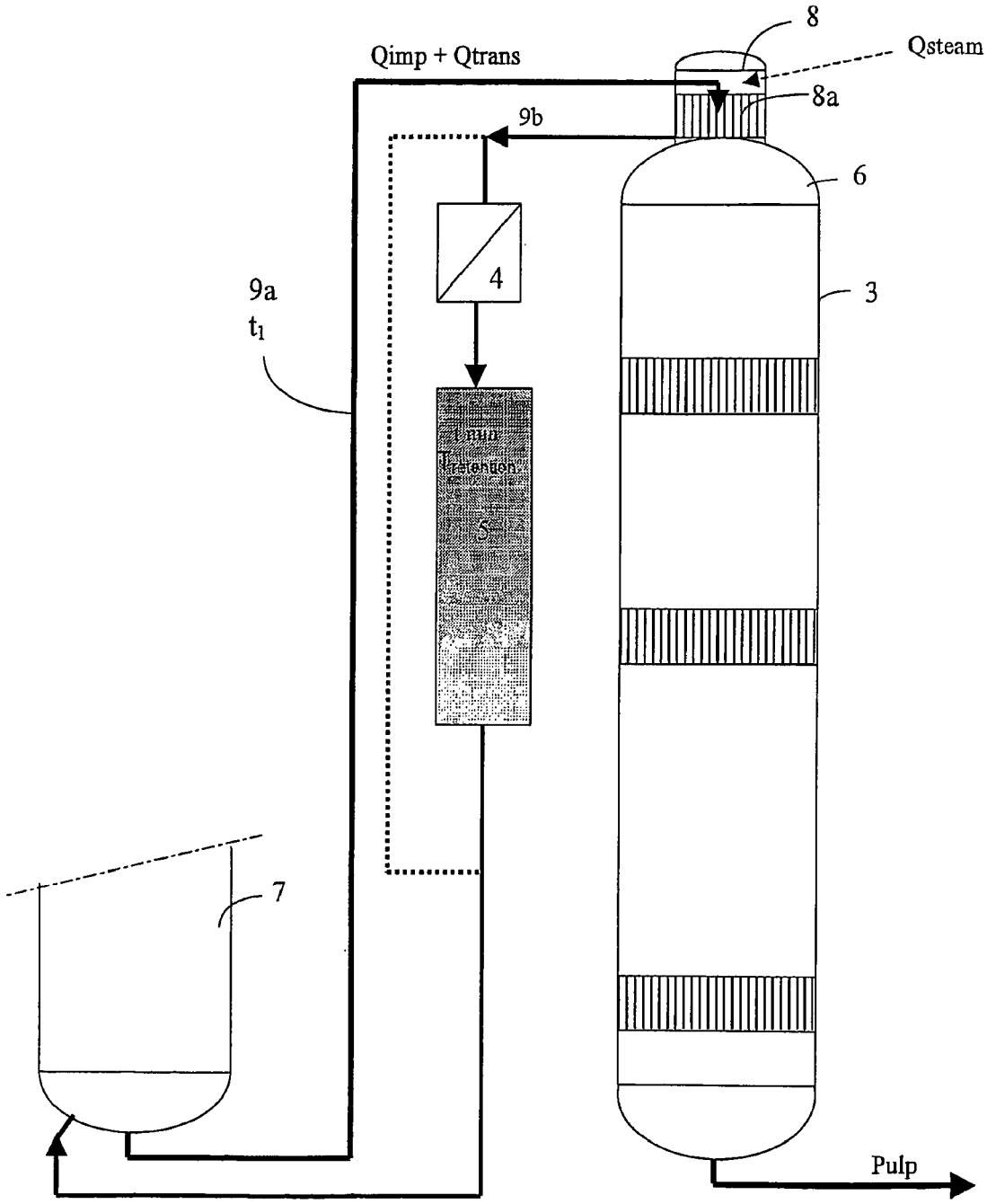
FIG. 1*b* shows an application to impregnation liquor in the transfer section of a two-vessel cooking system.

FIGS. 1*a* and 1*b* show how the invention can be applied to the hemicellulose-rich impregnation liquid. The invention is suitable for both single-vessel and two-vessel cooking systems in which the impregnation liquid can be drawn from various positions depending on the system and given a dwell time outside the cooking system in order to be subsequently returned to this same system, as is shown in FIG. 1*a* and FIG. 1*b*, respectively.

In a single-vessel cooking system in accordance with FIG. 1*a*, the chips are impregnated in a first zone 1 at the top of the digester 6 and the impregnation liquor $Q_{imp}$ is extracted in a first screen section 2 directly after this zone. In the subsequent first cooking zone 3, the treatment temperature is 10–40° C. higher than in the impregnation zone 1. In conventional digesters, the temperature is raised between the zones by, in a speeded-up external circulation, heating the process liquid in a heat exchanger 4 with the aid of steam. In the process according to the invention, it is therefore expedient to heat the impregnation liquor $Q_{imp}$, after it has been extracted, to a temperature which in the main corresponds to the temperature $T_{cook}$ in the cooking zone to which the impregnation liquor is to be added. It is especially expedient to do this before the liquor is given a dwell time t in the buffer tank 5 since this results in a better H factor and, as a result, a shorter dwell time t for the impregnation liquor $Q_{imp}$. During the time the impregnation liquor $Q_{imp}$ is kept in the buffer tank 5, hex-A is cleaved from the xylan which has been dissolved during the impregnation. When the impregnation liquor $Q_{imp}$ is then returned to the digester system, xylan can be reprecipitated in the pulp at the same time as the content of hex-A in the pulp decreases. This has several effects due to the fact that the yield increases and the quality of the pulp is improved with regard to tear strength, beatability, bleachability and reduced colour reversion. In order to obtain the desired effect, the dwell time t should be between 30 and 120 minutes, preferably is between 45 and 90 minutes, preferably at least 90 minutes, before the impregnation liquor $Q_{imp}$ is returned to the subsequent cooking zone 3. After the dwell time t in the buffer tank 5, the impregnation liquor $Q_{imp}$ is returned to what is in the main the same position from which it was extracted and no earlier than directly above the screen 2. "In the main the same position" is understood as meaning that the impregnation liquor is added to the sinking chip column at a position which is such that the difference in the level between the position at which it is added and the position from which it was withdrawn corresponds to a dwell time $t_1$, for the liquor in the chip column, of at most 5–10 minutes before the position in question reaches the level of extraction.

When being applied to a two-vessel cooking system, which is shown in FIG. 1*b*, the procedure is like that for a single-vessel cooking system apart from the fact that the impregnation liquor $Q_{imp}$ is extracted from the transfer circulation 9*a*, which consists of impregnated chips, impregnation liquid $Q_{imp}$ and transport liquid $Q_{trans}$, between an impregnation zone 1 in an impregnation vessel 7 and the top of the digester 8; however, the impregnation liquor $Q_{imp}$ can also be extracted in a screen section at the bottom of the impregnation vessel 7 (not shown). While the figure shows that all return liquid 9*b* in the transfer circulation 9*a* is conducted to the buffer tank 5, it is also possible for only a constituent quantity of the return liquid 9*b* in the transfer circulation 9*a* to be conducted to the buffer tank 5. After possible heating in the heat exchanger 4, and retention time in the buffer tank 5, the impregnation liquid $Q_{imp}$ is added at what is in the main the same position as that from which it was extracted, which results in a maximal dwell time $t_1$, of 5–10 minutes for the chips in the transfer section between the addition position and the extraction position, which is achieved by it being possible to conduct the impregnation liquid $Q_{imp}$ back to the bottom of the impregnation vessel 7 at the position for feeding out the impregnated chips or in a subsequent high pressure feeder (not shown) as part of the transport liquid $Q_{trans}$. In this way, the impregnation liquid from the buffer tank will constitute part of the liquid which accompanies the chips up into the digester 6. When this procedure is used, a certain part of the impregnation liquor $Q_{imp}$ which has already had its dwell time can come to be once again extracted to the buffer tank 5 and thereby recirculated once again in this loop.

Figure 1C:
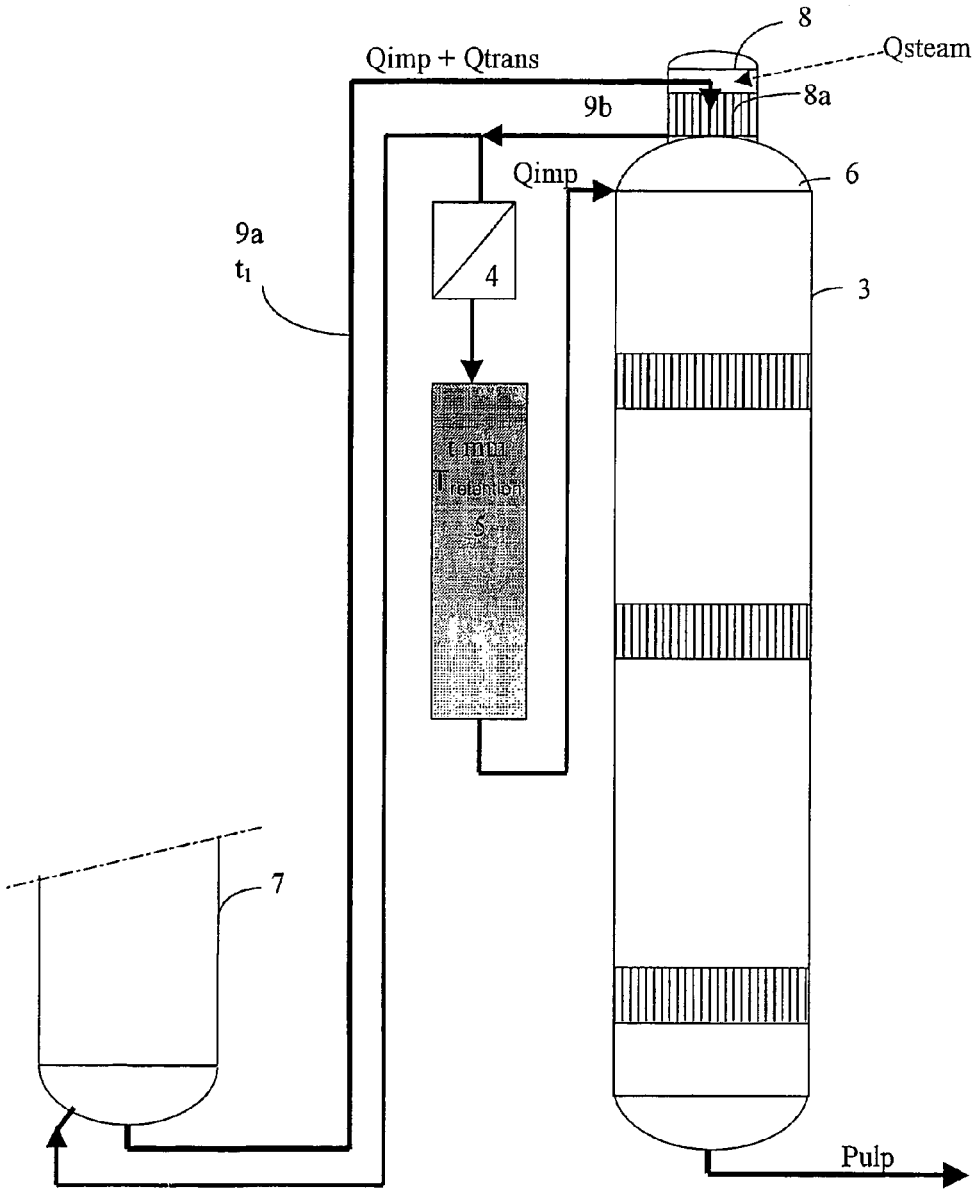
FIG. 1*c* shows another application to impregnation liquor in the transfer section of a two-vessel cooking system.

In another alternative, according to FIG. 1*c*, the impregnation liquor $Q_{imp}$ can, after possible heating in the heat exchanger 4 and retention time in the buffer tank 5, be conducted to the top of the digester 8, something which, in a steam/liquid-phase digester, means that the impregnation liquor $Q_{imp}$ is conducted to a position directly downstream of the top separator 8 or to an upper part of an inverted top separator in accordance with our patent U.S. Pat. No. 6,214,171 B1, in order, thereby, to accompany the chips down into the digester 6. The impregnation liquor $Q_{imp}$ then comes directly to constitute cooking liquid in the subsequent cooking zone 3. If necessary, direct steam $Q_{steam}$ can be added, in a conventional manner, to the top of the digester 8 for the purpose of adjusting the temperature.

The process according to the invention can also be employed in hydraulic digesters in which the extraction of the impregnation liquor from the transfer circulation can take place in a conventional screen section at the top of the digester or at the bottom of the impregnation vessel for subsequent handling in line with what has been described above.

In yet another variant, the invention can be applied to a process in accordance with that in WO001261, in which hemicellulose-rich impregnation liquid is conveyed to a final cooking zone for precipitating xylan in the final stage of the cooking. As has previously been explained, this can give rise to problems with shives in the pulp, which problems arise when chip pieces which accompany the impregnation liquid are not given sufficient time for delignification. Applying the present invention to this impregnation liquid provides a method for remedying this problem.

Providing the impregnation liquid, together with any chip pieces which may be present, with a minimum dwell time, before it is returned to the digester, of 30–120 minutes, preferably 45–90 minutes, or a time which corresponds to the dwell time for the chips between the position at which the liquor is extracted and the position at which it is returned, will also provide a substantial delignification of the chip pieces, thereby eliminating the risk of shives.

Application of the Invention to Cooking Liquid

Figure 2:
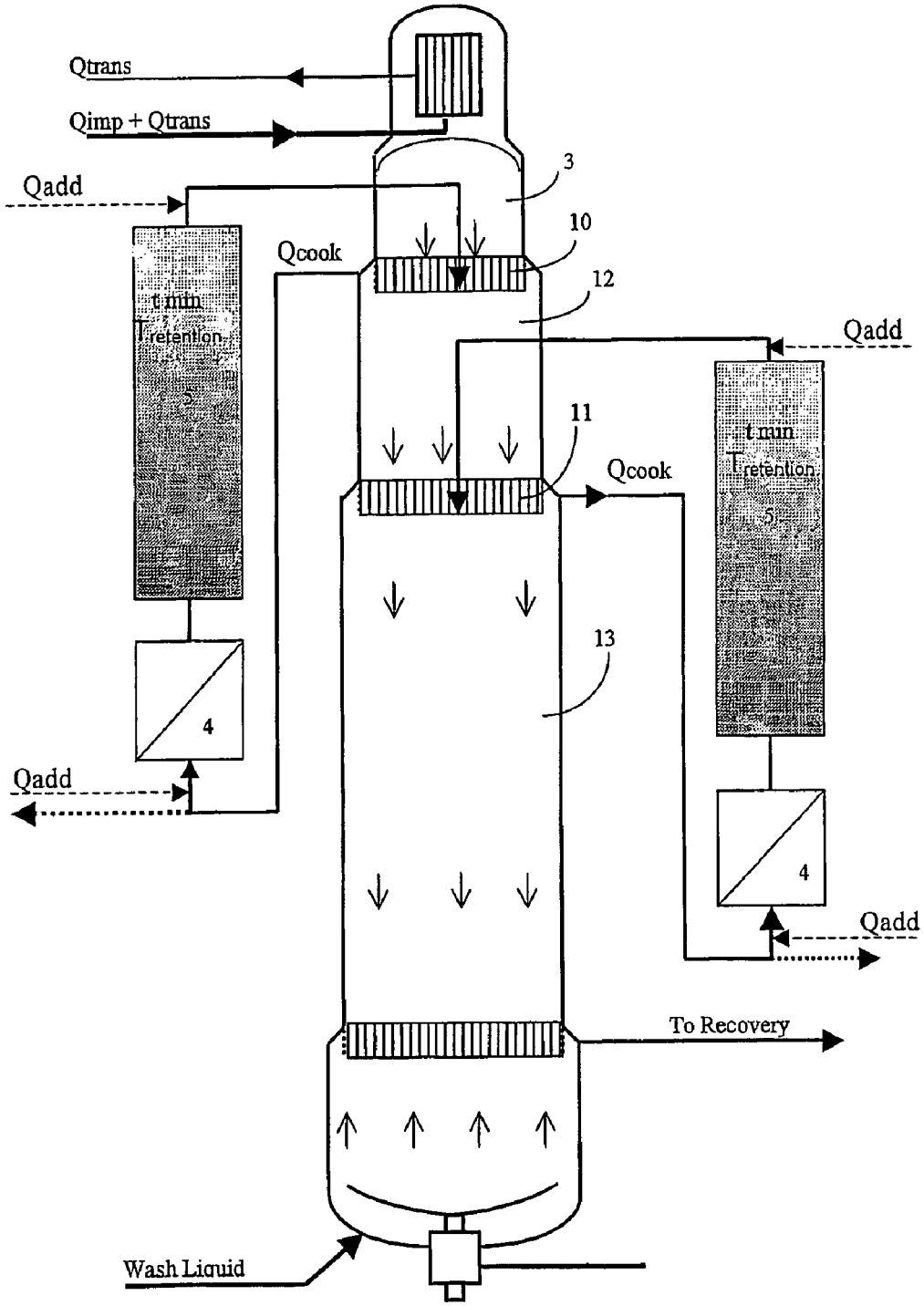
FIG. 2 shows an application to cooking liquid.

While, in a preferred embodiment, the invention is preferably applied to all the extractions of cooking liquid in the screen sections 10 and 11 between the different cooking zones 3, 12 and 13 in accordance with FIG. 2, the invention can also be applied to individual extractions and nevertheless fulfill the object according to the invention. Very good results have been obtained, in particular, when applying the invention in a final countercurrent cooking zone.

In the preferred embodiment, the process is applied such that extracted cooking liquid $Q_{cook}$ is given a dwell time t of between 30 and 120 minutes outside the digester system without the temperature of the extraction being allowed to fall below 100° C. during the dwell time t, and with the temperature preferably being in the main retained such that the temperature does not exceed the maximum cooking temperature $T_{cook}$ by more than 5° C. This is understood to mean that, as a rule, the cooking liquid (or, as previously, the impregnation liquid), is extracted without any external heating at all and that, if necessary, it is possible to add certain chemicals which can per se give rise to a certain exothermal heating of at most 5° C.

If the temperature of the extraction from the digester is equal to or greater than 140° C., the extraction liquid is not heated. In conformity with what was previously described for impregnation liquid, the extracted cooking liquid should be returned to what is in the main the same position as the extraction position, resulting in a maximum dwell time $t_1$ of 5–10 minutes in the chip column between the addition position and the extraction position.

The quantity of processed liquid, $Q_{imp}+Q_{cook}$, which is given a dwell time t should at least correspond to 50–100% preferably more than 60%, and even more preferably more than 70%, of the total extraction flow from the cooking department system to recovery, excluding the dilution factor.

As a minimum, at least 20% of the extracted process liquid $Q_{imp}+Q_{cook}$ should be conducted to the buffer tank 5 in each loop.

Depending on the retention temperature $T_{retention}$ in question, the dwell time t will vary, something which is controlled by what is termed the H factor. In order to obtain the same effect when the retention temperature $T_{retention}$ in the buffer tank 5 decreases, it is necessary for the retention time t to increase. According to established digester practice, a decrease in the cooking temperature by about 10° C. results in it being necessary to double the extent of the cooking time. It is consequently important to preserve the temperature of the extraction liquor during the dwell time in order not to be unnecessarily forced into long retention times, while it should at the same time be bome in mind that temperatures which are too high degrade xylan and should therefore be avoided.

In a variant of the invention, different additions, $Q_{add}$, can be made to the buffer tank for the purpose of augmenting the effect of this dwell time t (see FIG. 2). These additions, $Q_{add}$, can comprise, for example, white liquor, green liquor, black liquor, cellulose derivatives such as CMC, organic sulphides such as carbon disulphide, mercaptides, etc., AQ derivatives, etc. Extraction liquor containing a high content of hemicellulose, for example from a digester system using hardwood as the raw material, can also be used as an addition in a parallel production line in which softwood constitutes the raw material. These additions, $Q_{add}$, can also be added, and in that case first and foremost white liquor, green liquor or black liquor, after the buffer tank 5, possibly for adjusting the alkali content prior to the next treatment stage in the cooking department system.

The invention can be applied to both steam-phase digesters and hydraulic digesters, with an inverted top separator as well as a downwardly feeding top separator, and types without a top separator, and can be used when producing cellulose pulp in accordance with both the sulphite method and the kraft method. In the same way, hardwood, softwood, annual plants (of the bagasse or reed canarygrass type, etc.), and so on, can constitute the raw cellulose material. The effect of the invention is most evident when xylan-rich hardwood is used as the raw material.

The invention decreases the hex-A/xylan ratio in the hemicellulose which is reprecipitated onto the fibre since the process cleaves off hex-A from the xylan chains. Cleaving off the hex-A decreases the solubility of the xylan in the cooking liquid, thereby making it easier to reprecipitate it in the pulp; at the same time as the hex-A remains in solution in the extraction liquor. A lower content of hex-A in the pulp contributes to decreasing the colour reversion.

The invention can also be employed in both single-vessel and two-vessel digester systems and applied to all the extractions or extractions from individual impregnation zones and cooking zones. In single-vessel systems, the invention can, for example, be employed n an intermediate section of the cooking process where this intermediate section is preceded by impregnation or at least one other type of cooking zone and/or terminated with a cooking zone of another type or with a washing zone.

In order to retain the temperature of the extracted process liquid in the buffer tank, use can expediently be made of the remaining quantity of non-recirculated process liquid in order, thereby, by way of indirect heat exchange, to minimize the requirement for other heat, for example steam.

Besides fulfilling the objects, which have already been described, of improved pulp quality and increased yield, the process will lead to a decrease in the loading on the recovery side where, otherwise, hemicellulose and other dissolved organic material increase the loading. High loading on the recovery side is frequently the reason for it not being possible to implement desired increases in production.

The invention claimed is:

1. A process for continuously cooking chemical pulp with improved pulp quality and increased yield, comprising:

providing a digester system having at least one vessel for impregnating and cooking cellulose, the vessel having an inlet defined therein into which a mixture of chips and process liquid is fed, the vessel having an outlet defined therein, the vessel having an extraction position disposed between the inlet and the outlet, the chips and process liquid flowing in a flow direction, impregnating the chips at a predetermined impregnation temperature, $T_{imp}$, cooking the chips at a predetermined cooking temperature, $T_{cook}$, for at least 60 minutes, the chips passing through treatment zones in the digester system, continuously extracting process liquid from an extraction point, retaining the extracted process liquid in a buffer tank positioned outside the digester system during a dwell time (t) of at least 30 min, while in the outside buffer tank, maintaining the extracted process liquid at a temperature $T_{return}$ which is in an interval $T_{min}$–$T_{max}$, where $T_{min}$=100° C. and $T_{max}$=140° C., while maintaining the extracted process liquid in the buffer tank, cleaving hexenuronic acid (Hex-A) from xylan;

returning the retained process liquid to the extraction point from which the extracted process liquid was extracted, or downstream thereof, mixing the returned process liquid with process liquid in the treatment zones of the digester system, re-precipitating xylan, received from the buffer tank, in the digester system, while the cleaved hexenuronic acid remaining in solution in the process liquid, and feeding out cooked pulp through the outlet.

2. The process according to patent claim 1 wherein the dwell time (t) for the process liquid in a position outside the digester system is between 45 and 90 min.

3. The process according to patent claim 2 wherein a part of the process liquid is returned, after the dwell time (t) to the digester system, the part constituting at least 20% of the process liquid which was extracted at the same position.

4. The process according to patent claim 3 wherein a total quantity of the process liquid is returned, after the dwell time (t) to the digester system, the total quantity constituting at least 50% of a total extraction from the digester system to recovery.

5. The process according to patent claim 1 wherein at least one addition is made to the process liquid which is retained outside the digester system.

6. The process according to patent claim 5 wherein the addition is made to the extracted process liquid before the extracted process liquid is provided with a dwell time outside the digester system in order to augment an effect of the dwell time on the process liquid.

7. The process according to patent claim 6 wherein the addition includes adding white liquor, green liquor, blacic liquor, cellulose derivatives, AQ derivatives or extraction liquor.

* * * * *